US007568972B2

(12) United States Patent
Chung

(10) Patent No.: US 7,568,972 B2
(45) Date of Patent: Aug. 4, 2009

(54) COIN COUNTER

(75) Inventor: Shu-Chuan Chung, Kaohsiung Hsien (TW)

(73) Assignee: Shang Yang Industrial Co., Ltd., Kaohsiung Hsien (TW)

( * ) Notice: Subject to any disclaimer, the term of this patent is extended or adjusted under 35 U.S.C. 154(b) by 290 days.

(21) Appl. No.: 11/785,359

(22) Filed: Apr. 17, 2007

(65) Prior Publication Data

US 2008/0102742 A1 May 1, 2008

(30) Foreign Application Priority Data

Nov. 1, 2006 (TW) ..... 95219296 U

(51) Int. Cl.
*G07D 1/06* (2006.01)
*G07D 3/00* (2006.01)

(52) U.S. Cl. ..... 453/2; 453/49; 453/57; 453/59

(58) Field of Classification Search ..... 453/1, 453/2, 6, 10, 12, 13, 16, 17, 33–35, 49, 57, 453/58

See application file for complete search history.

(56) References Cited

U.S. PATENT DOCUMENTS 5,616,074 A * 4/1997 Chen ..... 453/30
6,786,814 B2 * 9/2004 Chen ..... 453/33

* cited by examiner

*Primary Examiner*—Jeffrey A Shapiro
(74) *Attorney, Agent, or Firm*—Finnegan, Henderson, Farabow, Garrett & Dunner, L.L.P.

(57) ABSTRACT

A coin counter includes a receptacle disposed on a stand and defining a space for coins. A rotary plate assembly is disposed in the space, and is driven by a drive assembly to eject the coins out of the receptacle. A rigid push rod forms a spacing with the rotary plate assembly that is substantially equal to a coin thickness. A counter counts the coins that are ejected. The counter includes a sensing element, an interrupting element, and a resilient element having ends coupled to the interrupting element and the stand. The interrupting element is in a path of ejection of the coins at a first position, and is displaced by a coin being ejected at a second position. The sensing element detects displacement of the interrupting element. The resilient element is pre-tensioned when the interrupting element is at the first position.

4 Claims, 6 Drawing Sheets

COIN COUNTER

CROSS-REFERENCE TO RELATED APPLICATION

This application claims priority of Taiwanese Application No. 095219296, filed on Nov. 1, 2006.

BACKGROUND OF THE INVENTION

1. Field of the Invention

The present invention relates to a coin counter, more particularly to a coin counter that ensures precise counting of coins.

2. Description of the Related Art

Referring to FIGS. 1 through 3, a conventional coin counter 1 used in, for example, a bank or a gaming center automatically counts coins. The conventional coin counter 1 includes a stand 11, a receptacle 12, a rotary plate assembly 14, a drive assembly 13, a push member 15, a counter 16, and a deactivation assembly 17.

The receptacle 12 is mounted on the stand 11, and defines a space 125 for holding coins. An opening 124 is formed at an upper end of the space 125 to allow coins to be supplied into the space 125. The drive assembly 13 drives the rotary plate assembly 14 to eject coins from the receptacle 12 through a slot (not shown) formed in the receptacle 12. The rotary plate assembly 14 defines regions 146, each designed to ideally hold a single coin. The push member 15 is made of a pliable material, and is provided in an effort to ensure that the coins are not stacked in each of the regions 146 (i.e., to ensure that only one coin is positioned in each of the regions 146) before being ejected out of the receptacle 12 by the rotary plate assembly 14. The counter 16 includes an interrupting element 162 that is displaced each time a coin is ejected out of the receptacle 12, a sensing element 161 that detects the displacement of the interrupting element 162, and a tension spring 163 having two ends coupled respectively to the stand 11 and the interrupting element 162. The tension spring 163 stores a restoring force when the interrupting element 162 is displaced so as to return the interrupting element 162 to its non-displaced position each time after a coin is ejected.

Detection signals output by the sensing element 161 are used to count the number of coins ejected out of the receptacle 12, that is, the number of coins in the receptacle 12.

The deactivation assembly 17 operates such that when coins are supplied into the receptacle 12, power to the drive assembly 13 is cut off to thereby temporarily discontinue operation of the drive assembly 13.

The conventional coin counter 1 has the following drawbacks:

1. Since the push member 15 is made of a pliable material as described above, the push member 15 is easily deformed, particularly when many coins are present in the receptacle 12. Deformation of the push member 15 may be such that the push member 15 is unable to perform its function of preventing the stacking of coins in the regions 146 defined by the rotary plate assembly 14. If this occurs, more than one coin may be ejected out of the receptacle 12 each time the interrupting element 162 is displaced, thereby resulting in counting errors.

2. The tension spring 163 starts at a non-tensioned, resting position, and is stretched when the interrupting element 162 is displaced. Since some displacement is needed before the tension spring 163 begins to store its restoring force, i.e., begins to be stretched, the overall reaction time of the tension spring 163 is slow. That is, there is a delayed reaction in the tension spring 163 returning the interrupting element 162 to its non-displaced position. In some instances, the delay may be significant enough so that more than one coin is ejected out of the receptacle 12 when the interrupting element 162 is displaced. This further contributes to the possibility of counting errors with the conventional coin counter 1.

SUMMARY OF THE INVENTION

Therefore, the object of this invention is to provide a coin counter configured to ensure that coins are precisely counted.

The coin counter of this invention comprises: a stand; a receptacle including a base wall disposed on the stand, and a peripheral wall extending from a peripheral portion of the base wall, the base wall and the peripheral wall defining a space that is adapted for holding coins and that has an opening adapted for allowing passage of coins into the space, the receptacle further including a coin exit member disposed on the base wall and spatially communicated with the space; a drive assembly including a driving member, and a drive shaft extending through the base wall of the receptacle and driven rotatably in a direction by the driving member; a rotary plate assembly disposed in the space adjacent to the base wall, the rotary plate assembly being coupled to and driven to rotate in the direction by the drive shaft so as to eject the coins out of the receptacle via the coin exit member; a rigid push rod including a fixed portion secured outwardly of the space, a mid-portion extending from the fixed portion into the space and toward the coin exit member, and a sweep portion extending from the mid-portion to a location proximate to the coin exit member, the sweep portion forming a spacing with one surface of the rotary plate assembly that is substantially equal to a thickness of the coins held in the receptacle; and a counter disposed on the base wall in proximity to the coin exit member and adapted to count the coins ejected by the rotary plate assembly.

The counter includes a sensing element, an interrupting element, and a resilient element having opposite ends coupled respectively to the interrupting element and the stand. The interrupting element is movable between a first position whereat the interrupting element is biased by the resilient element into a path of ejection of the coins, and a second position whereat the interrupting element is displaced against the biasing force of the resilient element by one of the coins being ejected into the coin exit member. The sensing element detects displacement of the interrupting element from the first position to the second position. The resilient element is pretensioned so as to be extended by a first extension amount when the interrupting element is at the first position, and by a second extension amount greater than the first extension amount when the interrupting element is at the second position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
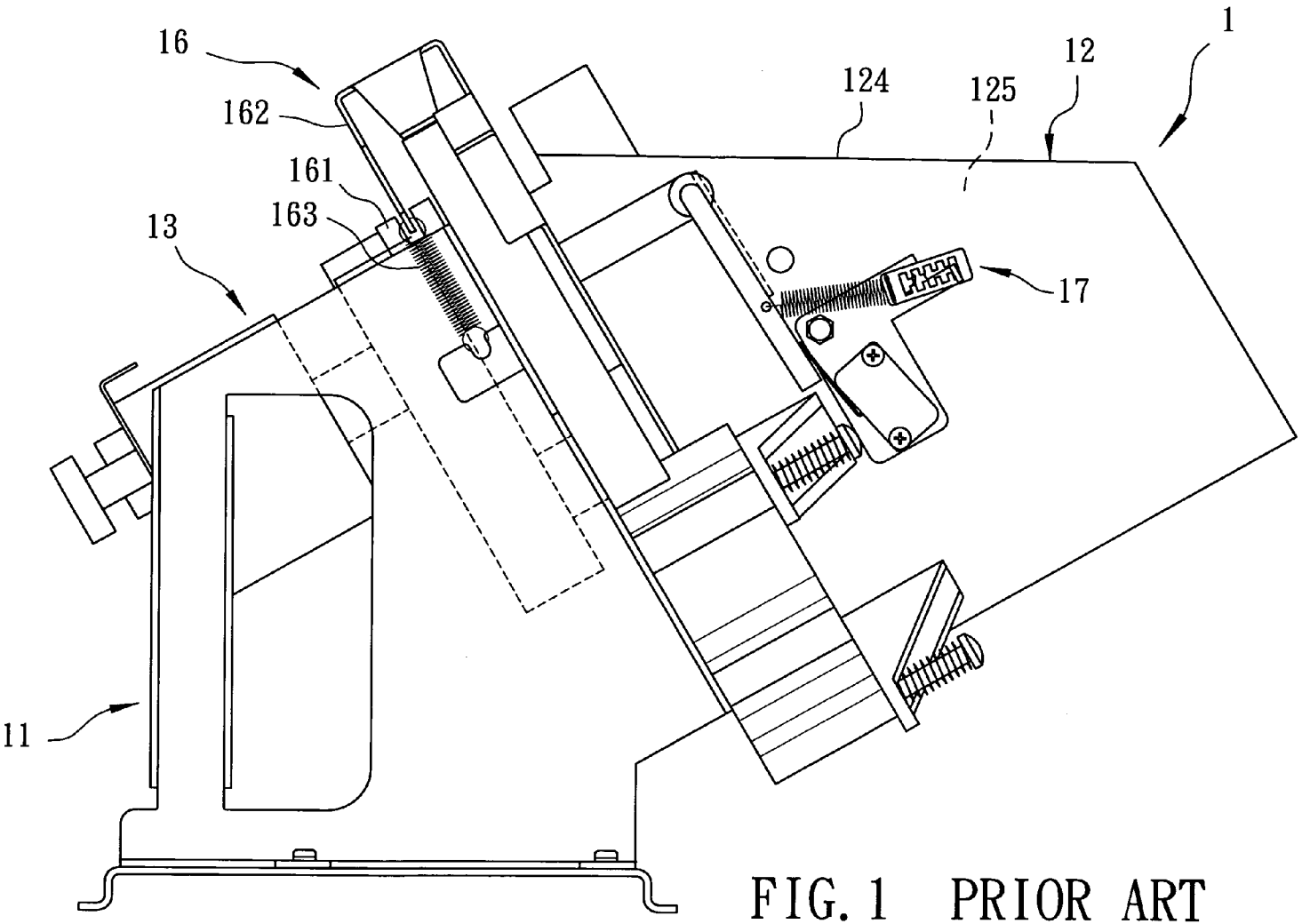
FIG. 1 PRIOR ART
FIG. 1 is a schematic side view of a conventional coin counter.
Figure 2:
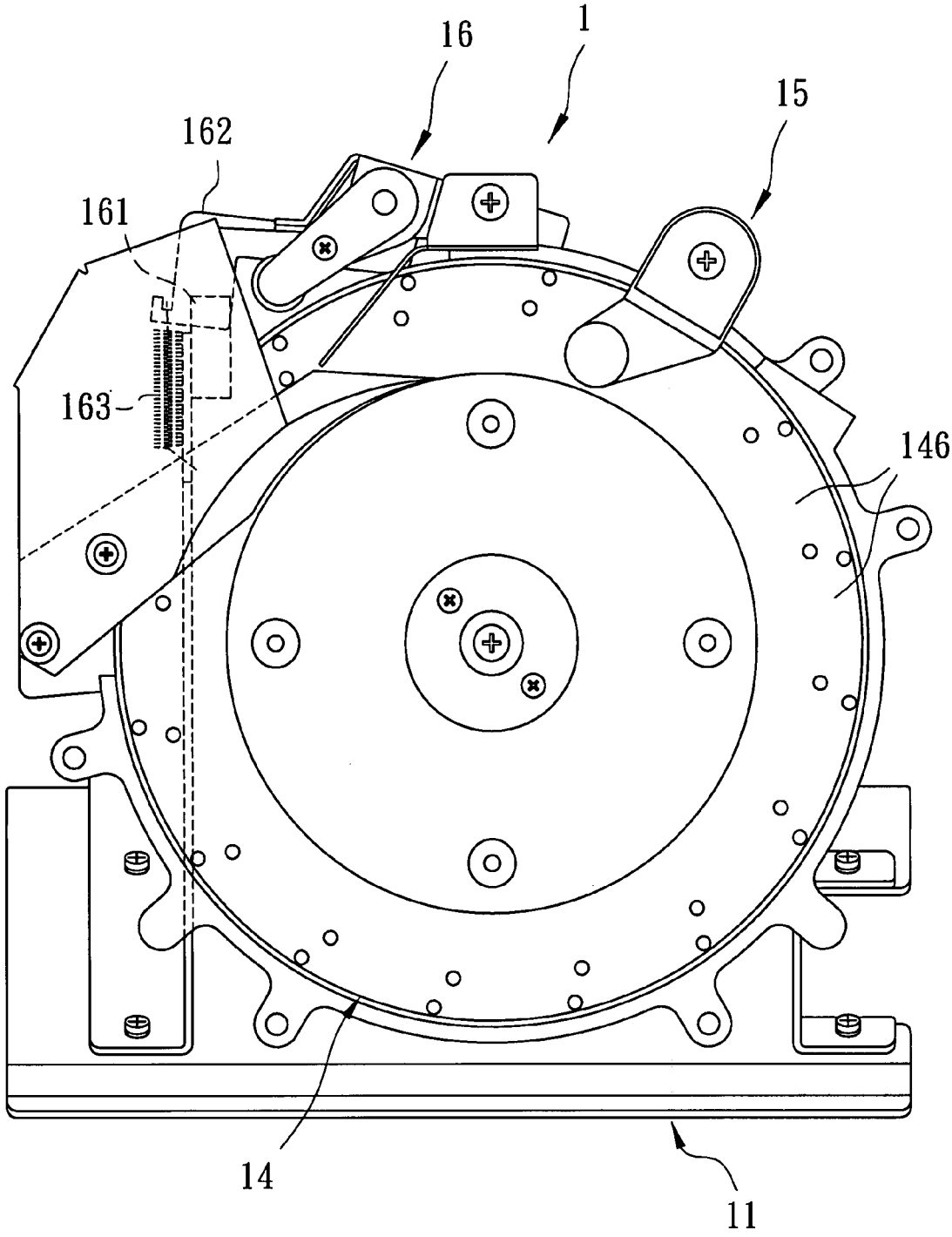
FIG. 2 PRIOR ART
FIG. 2 is a top plan view of the conventional coin counter of FIG. 1.
Figure 3:
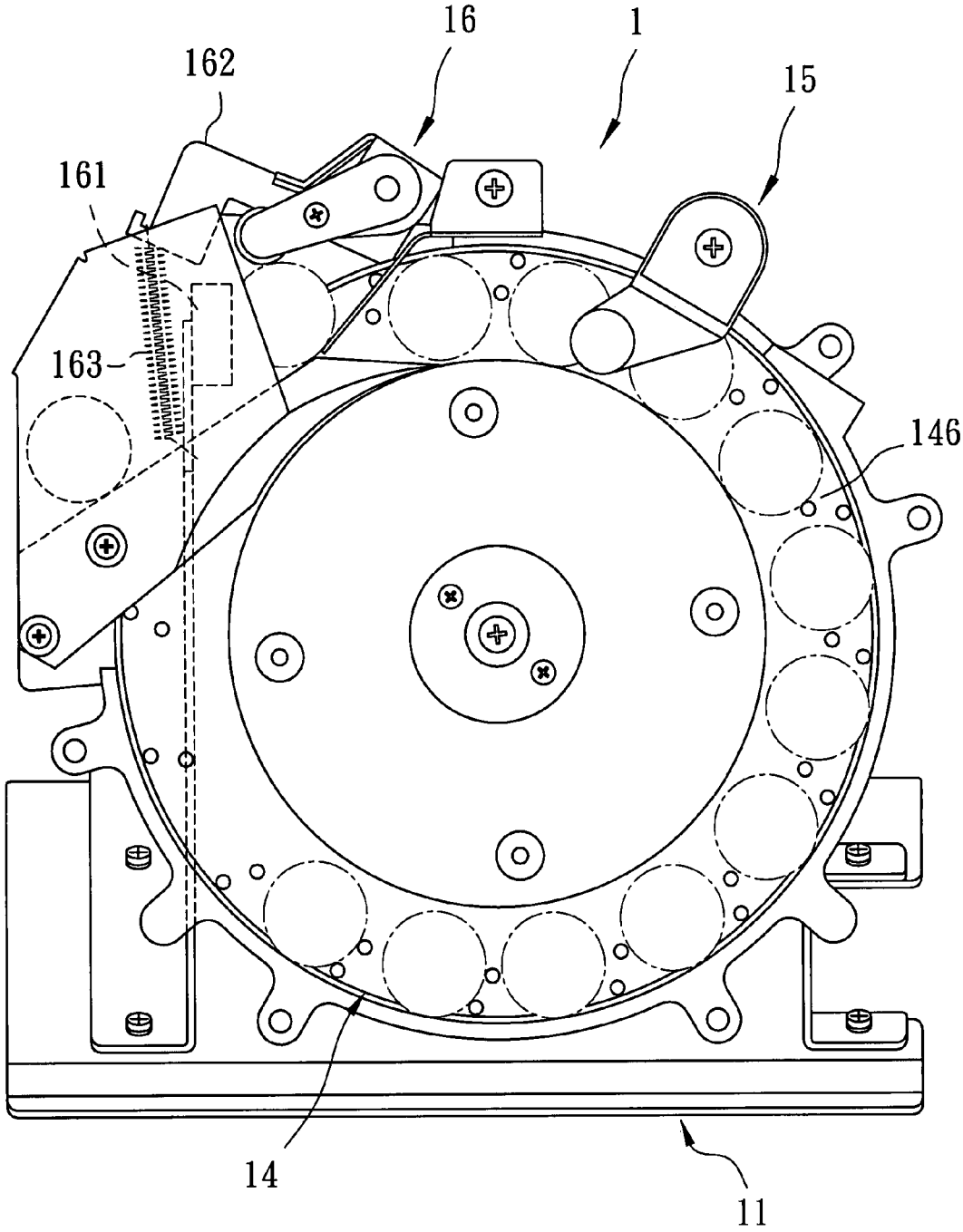
FIG. 3 PRIOR ART
FIG. 3 is a view similar to FIG. 2, but illustrating the counter in a state of use.
Figure 4:
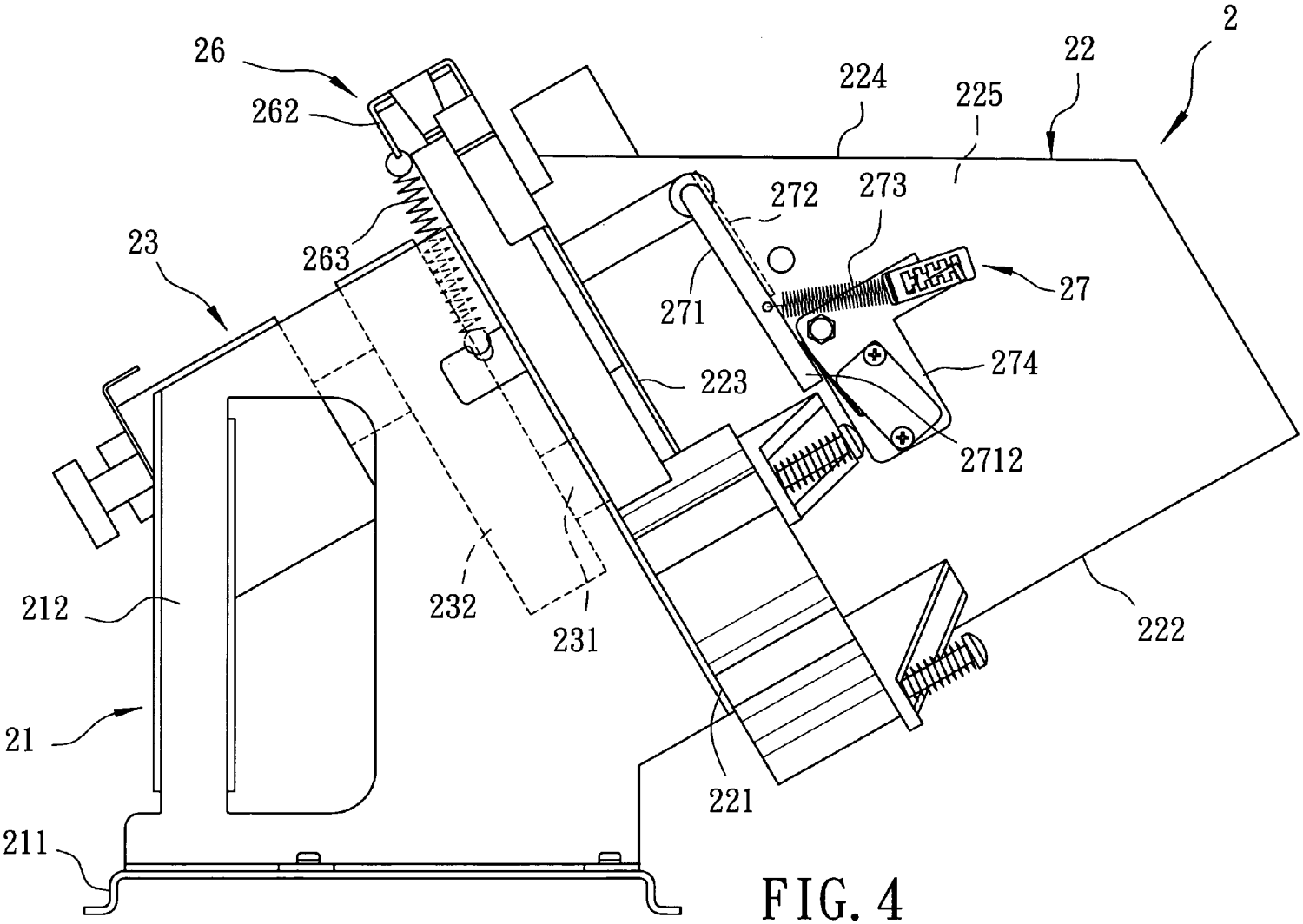
FIG. 4 is a schematic side view of a coin counter according to a preferred embodiment of the present invention.
Figure 5:
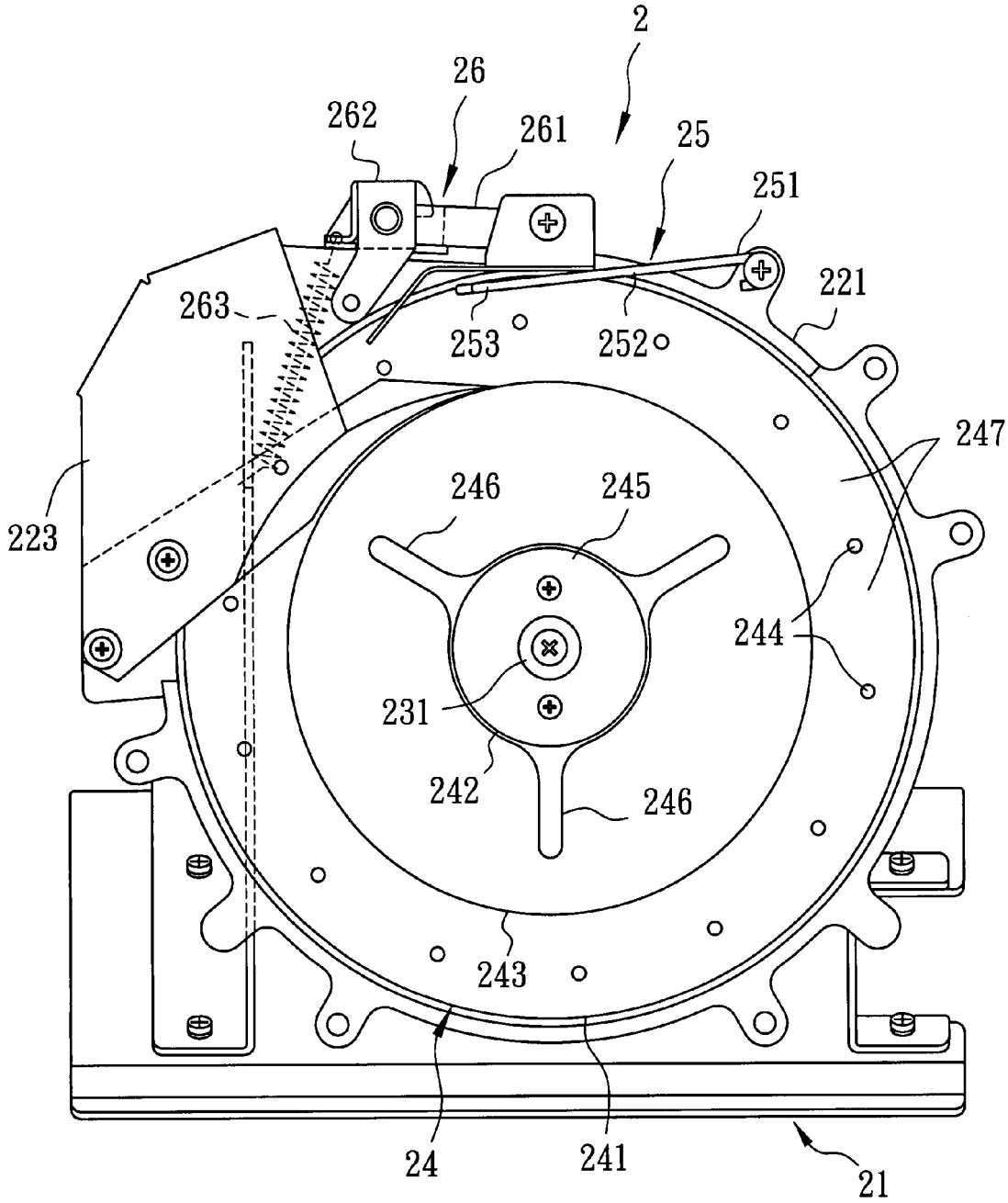
FIG. 5 is a top plan view of the coin counter of FIG. 4, illustrating an interrupting element of a counter at a first position.

Referring to FIGS. 4 and 5, a coin counter 2 according to a preferred embodiment of the present invention is adapted to automatically count coins. It is to be noted that the present invention may also be adapted to automatically count tokens. That is to say, any reference to "coins" herein also encompasses "tokens," and these terms are equivalent for the purposes of this disclosure.

The coin counter 2 includes a stand 21, a receptacle 22, a drive assembly 23, a rotary plate assembly 24, a push rod 25, a counter 26, and a deactivation assembly 27.

The stand 21 includes a bottom wall 211, and a pair of support walls 212 (only one is shown) extending upwardly from the bottom wall 211 in a spaced-apart manner. In this embodiment, an upper portion of each of the support walls 212 is formed at an angle relative to a lower portion of the corresponding support wall 212.

The receptacle 22 includes a base wall 221 disposed on the stand 21, and in particular, disposed to interconnect distal ends of the two support walls 212 of the stand 21, and a peripheral wall 222 extending from a peripheral portion of the base wall 221. The base wall 221 and the peripheral wall 222 define a space 225 that is adapted for holding coins and that has an opening 224 adapted for allowing passage of coins into the space 225. The receptacle 22 further includes a coin exit member 223 disposed on the base wall 221, and that is spatially communicated with the space 225 through a slot (not shown) formed in the peripheral wall 222.

The drive assembly 23 includes a driving member 232, and a drive shaft 231 extending through the base wall 221 of the receptacle 22 and driven rotatably in a direction by the driving member 232. In this embodiment, the driving member 232 is a motor that receives its power through electrical coupling with an alternating current power source.

The rotary plate assembly 24 is disposed in the space 225 adjacent to the base wall 221. The rotary plate assembly 24 is coupled to and driven to rotate in the direction by the drive shaft 231 so as to eject coins out of the receptacle 22 via the slot formed in the peripheral wall 222 and the coin exit member 223.

In this embodiment, the rotary plate assembly 24 includes a bottom plate 241 sleeved on the drive shaft 231 to be driven to rotate by the drive shaft 231, a push plate 242 fixedly disposed on one surface of the bottom plate 241 to thereby rotate together with the bottom plate 241, a region-forming ring 243 disposed on the surface of the bottom plate 241 and at least partially surrounding the push plate 242, and a plurality of protrusions 244 disposed circumferentially spaced apart on the surface of the bottom plate 241 in an area between the region-forming ring 243 and a periphery of the bottom plate 241. A region 247 that is adapted to hold one coin is defined among the region-forming ring 243 and each adjacent pair of the protrusions 244. In this embodiment, the push plate 242 includes a center portion 245 secured on the bottom plate 241, and a plurality of pliable arms 246 extending outwardly from an outer periphery of the center portion 245 in a circumferentially spaced apart manner.

The push rod 25 is made of a rigid material, such as metal. The push rod 25 includes a fixed portion 251 secured outwardly of the space 225, a mid-portion 252 extending from the fixed portion 251 into the space 225 and toward the coin exit member 223, and a sweep portion 253 extending from the mid-portion 252 to a location proximate to the coin exit member 223. In this embodiment, the fixed portion 251 is secured to the base wall 221, and the mid-portion 252 extends from the fixed portion 251 into the space 225 through a hole (not shown) formed in the peripheral wall 222 of the receptacle 22. The sweep portion 253 forms a spacing with one surface of the rotary plate assembly 24 that is substantially equal to a thickness of the coins held in the receptacle 22. In this embodiment, the sweep portion 253 is J-shaped.

The counter 26 is disposed on the base wall 221 in proximity to the coin exit member 223, and is adapted to count the coins ejected by the rotary plate assembly 24. The counter 26 includes a sensing element 261, an interrupting element 262, and a resilient element 263 having opposite ends coupled respectively to the interrupting element 262 and the stand 21.

The interrupting element 262 is movable between a first position (see FIG. 5) whereat the interrupting element 262 is biased by the resilient element 263 into a path of ejection of the coins, and a second position (see FIG. 6) whereat the interrupting element 262 is displaced against the biasing force of the resilient element 263 by one of the coins being ejected into the coin exit member 223.

The sensing element 261 detects displacement of the interrupting element 262 from the first position to the second position, and outputs a corresponding signal that is used by a controller (not shown) for counting the coins in the receptacle 22 in a known manner. In this embodiment, the controller equates each output signal of the sensing element 261 to the ejection of one coin from the receptacle 22. Furthermore, in this embodiment, the sensing element 261 is a photosensor-type of sensor having a light source and a light sensor. In this case, the interrupting element 262 prevents the light sensor from receiving the light emitted by the light source while a coin is being ejected from the receptacle 22 (i.e., when the interrupting element 262 is at the second position).

The resilient element 263 is pre-tensioned so as to be extended by a first extension amount when the interrupting element 262 is at the first position, and by a second extension amount, which is greater than the first extension amount, when the interrupting element 262 is at the second position. In other words, when the interrupting element 262 is at the first position, the resilient element 263 is extended by the first extension amount, and when the interrupting element 262 is at the second position, the resilient element 263 is displaced by the interrupting element 262 to be extended by the second extension amount.

The deactivation assembly 27 includes a rod 271, a press plate 272, an urging member 273, and a cutoff controller 274. The rod 271 is rotatably inserted into the peripheral wall 222, and has a first segment 2712 disposed outwardly of the space 225, and a second segment (not shown) disposed in the space 225. The press plate 272 is disposed on the second segment of the rod 271 in proximity to the opening 224 of the space 225. The press plate 272 is movable between a third position and a fourth position. The urging member 273 has opposite ends coupled respectively to the rod 271 and the peripheral wall 222. The cutoff controller 274 is operable to selectively cut off the supply of power to the drive assembly 23.

When the press plate 272 is at the third position, the first segment 2712 of the rod 271 contacts the cutoff controller 274 such that the cutoff controller 274 operates to supply power to the drive assembly 23. When the press plate 272 is displaced to the fourth position by coins supplied into the receptacle 22 striking the press plate 272, the rod 271 is correspondingly caused to rotate and the urging member 273 is correspondingly caused to store a restoring force such that the first segment 2712 is separated from the cutoff controller 274 and such that the cutoff controller 274 operates to cut off power to the drive assembly 23.

Figure 6:
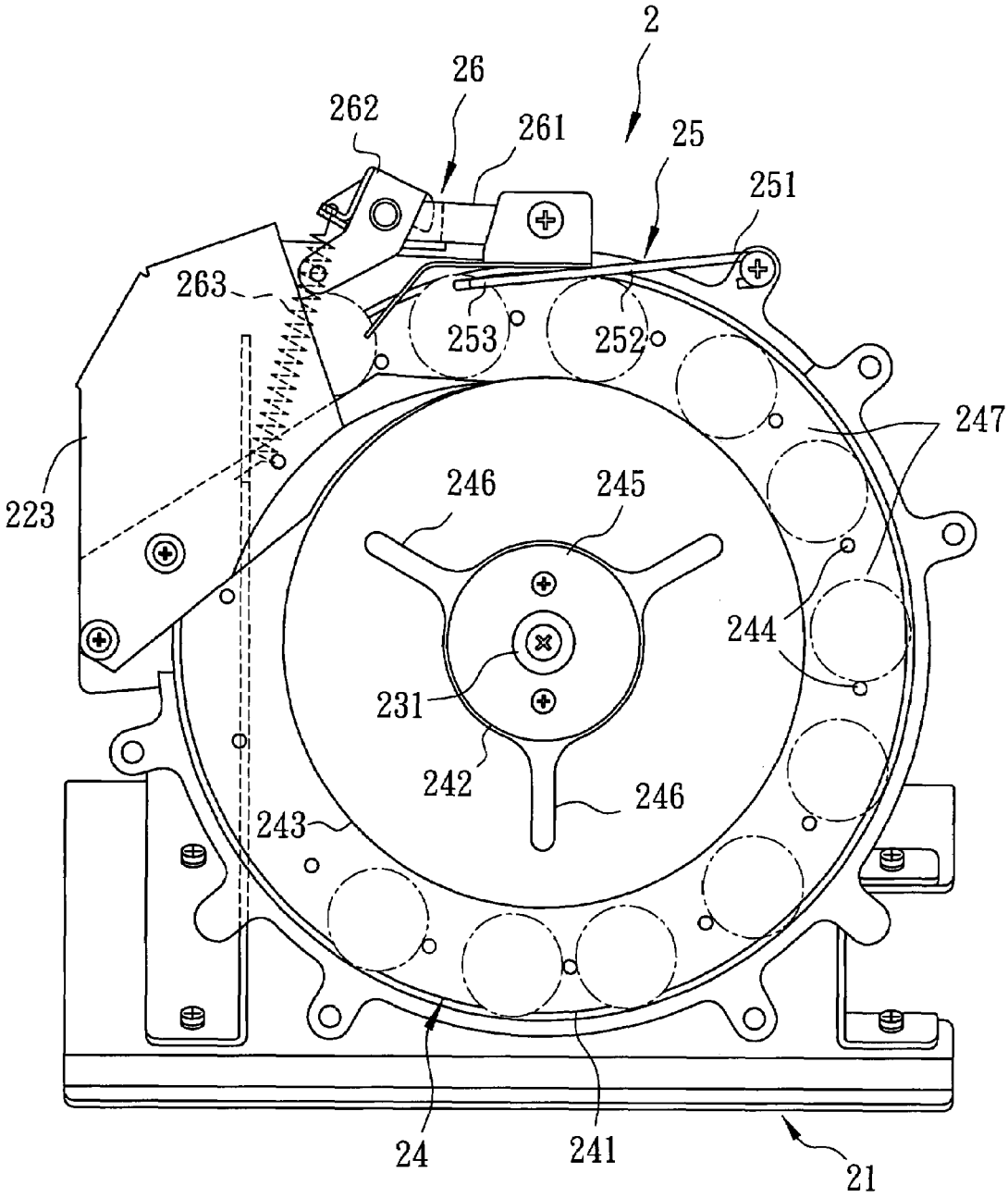
FIG. 6 is a view similar to FIG. 5, but illustrating the interrupting element at a second position.

The operation of the coin counter 2 of the present invention will now be described in greater detail with further reference to FIG. 6.

First, if at any point during operation of the coin counter 2, a large number of coins are supplied into the receptacle 22 via the opening 224, the press plate 272 is displaced to the fourth position such that, ultimately, the cutoff controller 274 operates to cut off power to the drive assembly 23 as described above.

Hence, rotation of the rotary plate assembly 24 is temporarily discontinued during the supply of coins into the receptacle 22. Since precise functioning of the push rod 25 and the counter 26 may be compromised while coins are being supplied into the receptacle 22, such operation of the deactivation assembly 27 ensures that counting errors do not occur during the process of supplying a large number of coins into the receptacle 22. After the coins are supplied into the receptacle 22, the press plate 272 is returned to the third position, such that the cutoff controller 274 operates to supply power to the drive assembly 23.

During normal operation of the coin counter 2, that is, when power is being supplied to the drive assembly 23, the driving member 232 rotates the drive shaft 231 in the direction, and thus, the rotary plate assembly 24 is driven to rotate in the direction. During such rotation of the rotary plate assembly 24, the pliable arms 246 of the push plate 242 help to stir the coins in the space 225 to thereby randomly cause a plurality of the coins to be disposed respectively in the regions 247. Therefore, the plurality of the coins are arranged in a ring shape as a result of being disposed within the regions 247, and are carried along with the rotary plate assembly 24 during rotation of the same.

When the rotary plate assembly 24 carries the coins past the sweep portion 253 of the push rod 25, since the spacing between the sweep portion 253 and the surface of the rotary plate assembly 24 is substantially equal to the thickness of the coins used in the coin counter 2, the stacking of a plurality of coins in each of the regions 247 is prevented. Hence, it is ensured that each of the regions 247 has a single coin positioned therein. The push rod 25 may also help to ensure that no coins are present in the spaces between the regions 247.

The rotary plate assembly 24 continues to direct the coins positioned in the regions 247 toward the counter 26. When a coin reaches the counter 26 and continues to be carried along by the rotary plate assembly 24, the interrupting element 262 is displaced from the first position to the second position. The sensing element 261 detects the displacement of the interrupting element 262 from the first position to the second position, and outputs a corresponding signal to the controller.

When the coin is moved fully past the interrupting element 262, the interrupting element 262 is returned to the first position by the resilient element 263. At this time, full ejection of the coin through the slot in the receptacle 22 and the coin exit member 223 is effected by the continued rotation of the rotary plate assembly 24 functioning to carry along the coin, and may be aided or accelerated by the squeezing of the coin between the interrupting element 262 and an inner wall of the coin exit member 223.

The above process is repeated for all the coins in the receptacle 22.

The coin counter 2 of the present invention has the following advantages:

1. The push rod 25 is made of a rigid material. As a result, the push rod 25 is able to prevent coins from being stacked in the regions 247 before being directed toward the counter 26 and out through the coin exit member 223. That is, the push rod 25 does not undergo deformation so that it does not encounter the problem of being unable to prevent stacking of coins in the regions 247, as in the case with the push member 15 used in the prior art. Hence, the precise counting of coins is ensured.

2. The resilient element 263 of the counter 26 is pre-tensioned by the first extension amount when the interrupting element 262 is at the first position, and is then further extended by the second extension amount when the interrupting element 262 is at the second position. In other words, stretching of the resilient element 263 starts in a state where it is pre-tensioned. This quickens the reaction time of the resilient element 263 so that the interrupting element 262 is rapidly returned to the first position after a coin is passed into the coin exit member 223. This prevents more than one coin from being ejected out of the receptacle 22 when the interrupting element 262 is displaced, such that the precise counting of coins is further ensured.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A coin counter, comprising:

a stand;

a receptacle including a base wall disposed on said stand, and a peripheral wall extending from a peripheral portion of said base wall, said base wall and said peripheral wall defining a space that is adapted for holding coins and that has an opening adapted for allowing passage of coins into said space, said receptacle further including a coin exit member disposed on said base wall and spatially communicated with said space;

a drive assembly including a driving member, and a drive shaft extending through said base wall of said receptacle and driven rotatably in a direction by said driving member;

a rotary plate assembly disposed in said space adjacent to said base wall, said rotary plate assembly being coupled to and driven to rotate in the direction by said drive shaft so as to eject the coins out of said receptacle via said coin exit member;

a rigid push rod including a fixed portion secured outwardly of said space, a mid-portion extending from said fixed portion into said space and toward said coin exit member, and a sweep portion extending from said mid-portion to a location proximate to said coin exit member, said sweep portion forming a spacing with one surface of said rotary plate assembly that is substantially equal to a thickness of the coins held in said receptacle; and a counter disposed on said base wall in proximity to said coin exit member and adapted to count the coins ejected by said rotary plate assembly, said counter including a sensing element, an interrupting element, and a resilient element having opposite ends coupled respectively to said interrupting element and said stand, said interrupting element being movable between a first position whereat said interrupting element is biased by said resilient element into a path of ejection of the coins, and a second position whereat said interrupting element is displaced against the biasing force of said resilient element by one of the coins being ejected into said coin exit member, said sensing element detecting displacement of said interrupting element from the first position to the second position, said resilient element being pre-tensioned so as to be extended by a first extension amount when said interrupting element is at the first position, and by a second extension amount greater than the first extension amount when said interrupting element is at the second position.

2. The coin counter of claim 1, further comprising a deactivation assembly including:

a rod rotatably inserted into said peripheral wall, and having a first segment disposed outwardly of said space, and a second segment disposed in said space;

a press plate disposed on said second segment of said rod in proximity to said opening of said space, said press plate being movable between a third position and a fourth position;

an urging member having opposite ends coupled respectively to said rod and said peripheral wall; and a cutoff controller operable to selectively cut off the supply of power to said drive assembly;

wherein when said press plate is at the third position, said first segment of said rod contacts said cutoff controller such that said cutoff controller operates to supply power to said drive assembly, and when said press plate is displaced to the fourth position by coins supplied into said receptacle striking said press plate, said rod is correspondingly caused to rotate and said urging member is correspondingly caused to store a restoring force such that said first segment is separated from said cutoff controller and such that said cutoff controller operates to cut off power to said drive assembly.

3. The coin counter of claim 2, wherein said rotary plate assembly includes a bottom plate sleeved on said drive shaft to be driven to rotate by said drive shaft, a push plate fixedly disposed on one surface of said bottom plate to thereby rotate together with said bottom plate, a region-forming ring disposed on said surface of said bottom plate and at least partially surrounding said push plate, and a plurality of protrusions disposed circumferentially spaced apart on said surface of said bottom plate in an area between said region-forming ring and a periphery of said bottom plate, a region that is adapted to hold one coin being defined among said region-forming ring and each adjacent pair of said protrusions.

4. The coin counter of claim 3, wherein said push plate includes a center portion secured on said bottom plate, and a plurality of arms extending outwardly from an outer periphery of said center portion in a circumferentially spaced apart manner.

* * * * *